US010524068B2

(12) United States Patent
Karamuk et al.

(10) Patent No.: US 10,524,068 B2
(45) Date of Patent: Dec. 31, 2019

(54) HEARING ASSISTANCE DEVICE TRANSDUCERS AND HEARING ASSISTANCE DEVICES WITH SAME

(71) Applicant: Sonova AG, Stäfa (CH)

(72) Inventors: Erdal Karamuk, Männedorf (CH); Markus Mueller, Männedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/068,443

(22) PCT Filed: Jan. 7, 2016

(86) PCT No.: PCT/IB2016/050052
§ 371 (c)(1),
(2) Date: Jul. 6, 2018

(87) PCT Pub. No.: WO2017/118878
PCT Pub. Date: Jul. 13, 2017

(65) Prior Publication Data
US 2019/0014426 A1 Jan. 10, 2019

(51) Int. Cl.
*H04R 25/00* (2006.01)
*H04R 11/02* (2006.01)
*H04R 11/04* (2006.01)

(52) U.S. Cl.
CPC ..... *H04R 25/65* (2013.01); *H04R 25/602* (2013.01); *H04R 25/604* (2013.01); *H04R 11/02* (2013.01); *H04R 11/04* (2013.01); *H04R 2225/025* (2013.01); *H04R 2225/61* (2013.01)

(58) Field of Classification Search
CPC ..... H04R 2225/023; H04R 2460/03; H04R 25/00; H04R 25/60; H04R 11/02; H04R 1/10; H04R 1/38; H04R 2225/025; H04R 2225/31; H04R 2225/43; H04R 2225/55; H01M 12/06; H01M 2002/0205; H01M 2/0413; H01M 2/361; Y02E 60/128
USPC ..... 381/328, 312, 315, 322, 324, 417; 429/176, 164
See application file for complete search history.

(56) References Cited

U.S. PATENT DOCUMENTS

| | | | |
|---|---|---|---|
| 5,193,116 | A | 3/1993 | Mostardo |
| 8,971,554 | B2 | 3/2015 | Van Halteren et al. |
| 2004/0151334 | A1 | 8/2004 | Vaudrey et al. |
| 2012/0114156 | A1 | 5/2012 | Serman et al. |
| 2012/0216418 | A1 | 8/2012 | Serman et al. |

(Continued)

FOREIGN PATENT DOCUMENTS

| | | | |
|---|---|---|---|
| WO | WO 00/69216 | A2 | 11/2000 |
| WO | WO 2010/116005 | A2 | 10/2010 |
| WO | WO 2010/120243 | A1 | 10/2010 |

OTHER PUBLICATIONS

PCT Search Report dated Jul. 13, 2016 for PCT App. Ser. No. PCT/IB2016/050052.

*Primary Examiner* — Curtis A Kuntz
*Assistant Examiner* — Julie X Dang
(74) *Attorney, Agent, or Firm* — Henricks Slavin LLP

(57) ABSTRACT

An electro-acoustic transducer including a housing having an interior volume with first and second interior volume portions and a sound aperture that extends to the first interior volume, a diaphragm located between the first and second interior volumes, and an environmental sensor associated with the housing and having an inlet in fluid communication with the first interior volume.

20 Claims, 4 Drawing Sheets

(56) References Cited

U.S. PATENT DOCUMENTS

| | | | | |
|---|---|---|---|---|
| 2013/0130097 | A1* | 5/2013 | Wenzel | H01M 2/0413 429/176 |
| 2013/0195299 | A1 | 8/2013 | Iseberg et al. | |
| 2013/0343584 | A1 | 12/2013 | Bennett et al. | |
| 2013/0343585 | A1 | 12/2013 | Bennett et al. | |
| 2014/0044294 | A1* | 2/2014 | Burns | H04R 25/00 381/328 |
| 2014/0254856 | A1 | 9/2014 | Blick et al. | |
| 2014/0321682 | A1* | 10/2014 | Kofod-Hansen | H04R 25/305 381/315 |
| 2015/0010199 | A1* | 1/2015 | Kim | H04R 11/02 381/417 |

* cited by examiner

HEARING ASSISTANCE DEVICE TRANSDUCERS AND HEARING ASSISTANCE DEVICES WITH SAME

CROSS-REFERENCE TO RELATED APPLICATIONS

This application is the U.S. National Stage of PCT App. Ser. No. PCT/IB2016/050052, filed Jan. 7, 2016.

BACKGROUND

1. Field

The present inventions relate generally to hearing assistance devices.

2. Description of the Related Art

A wide variety of hearing assistance devices (or "hearing devices") are available. Such devices include, but are not limited to, hearing aids and implantable cochlear stimulation ("ICS") systems. Hearing aids include a microphone, sound processor circuitry, and a speaker (referred to herein as a "receiver") located within a housing. Ambient sound pressure waves are picked up by the microphone and converted into electrical signals. The electrical signals, in turn, are processed by sound processor circuitry. The processed signals drive the receiver, which delivers amplified (or otherwise processed) sound pressure waves to the ear canal. Exemplary types of hearing aids include, but are not limited to, behind-the-ear ("BTE") hearing aids, receiver-in-canal ("RIC") hearing aids, in-the-canal ("ITC") hearing aids and completely in-the-canal ("CIC") hearing aids. Some CIC hearing aids are configured to be worn continuously, from several weeks to several months, inside the ear canal. Examples of extended wear hearing devices are disclosed in U.S. Pat. Nos. 7,664,282, 8,682,016 and 9,071,914, each of which is incorporated herein by reference.

ICS systems, one the other hand, commonly include an implantable device and an external sound processor with a housing (e.g., a body worn sound processor or a BTE sound processor), sound processor circuitry, a microphone that is in communication with the sound processor circuitry, and a battery or other power supply. The sound processor transmits stimulation data, as well as power from its power supply, to the implantable device by way of an inductive link between implantable device and a headpiece that is connected to the external sound processor. A representative ICS system is disclosed in U.S. Pat. No. 5,824,022, which is entitled "Cochlear Stimulation System Employing Behind-The-Ear Sound Processor with Remote Control" and incorporated herein by reference in its entirety.

Environmental state data, such as humidity and/or temperature, is sensed by some hearing assistance devices and used, for example, to adjust an operating parameter of the hearing aid (e.g., gain level, input and output levels of the microphone, or frequency response), to determine that an in-the-ear hearing assistance device is actually located within the ear canal, and to control an external drying apparatus.

One issue associated with hearing assistance devices is related to the fact that their integrity must be maintained despite prolonged exposure to a relatively harsh environment which includes substances such as sweat, cerumen (or "ear wax") and soapy water. These substances tend to block openings into the housing, such as the sound inlet port for the microphone, the sound outlet port for the receiver, and the vents for the compartment that stores metal-air batteries. The blockage necessitates maintenance and repair of the hearing assistance device. As such, the manufacturers of hearing assistance devices employ various filters and other protection elements, which must be periodically cleaned or changed, to prevent the openings into the housing from becoming blocked.

The present inventors have determined that adding humidity and/or temperature sensors (collectively "environmental sensors"), which must be exposed to the environment outside the hearing assistance device, to the interior of the hearing assistance device necessitates the use of additional filters and other protection elements. The additional protection elements increase the size, complexity and cost of the hearing assistance device. The addition of an environmental sensor also reduces the user-friendliness of the hearing assistance device because the additional filter (or other protection element) associated with the additional opening for the sensor element must be periodically cleaned and maintained.

SUMMARY

An electro-acoustic transducer, such as receiver or a microphone, in accordance with at least one of the present inventions includes a housing having a plurality of walls that define an interior volume with first and second interior volume portions and a sound aperture that extends through at least one of the walls to the first interior volume, a diaphragm located between the first and second interior volumes, and an environmental sensor associated with the housing and having an inlet in fluid communication with the first interior volume.

A method in accordance with at least one of the present inventions includes the step of sensing environmental data from within an acoustic transducer of a hearing device.

A hearing device in accordance with at least one of the present inventions includes a microphone, a receiver, and an environmental sensor associated with one of the microphone housing and the receiver housing and having a sensor inlet in fluid communication with the first interior volume of the associated microphone housing or receiver housing There are a variety of advantages associated with such apparatus and methods. By way of example, but not limitation, the present inventions facilitate the use of an existing acoustic pathway to connect an internal environmental sensor to the ambient environment, thereby obviating the need for additional protection elements that increase the size, complexity and cost of the hearing device. Additionally, because the present invention incorporate the environment sensor into an existing open volume with the hearing device, thereby providing the environment sensing functionality without increasing the overall size of the hearing device.

The above described and many other features of the present inventions will become apparent as the inventions become better understood by reference to the following detailed description when considered in conjunction with the accompanying drawings.

BRIEF DESCRIPTION OF THE DRAWINGS

Detailed descriptions of the exemplary embodiments will be made with reference to the accompanying drawings.

DETAILED DESCRIPTION OF EXEMPLARY EMBODIMENTS

The following is a detailed description of the best presently known modes of carrying out the inventions. This description is not to be taken in a limiting sense, but is made merely for the purpose of illustrating the general principles of the inventions. It should also be noted that if and when used herein, the term "lateral" refers to the direction and parts of hearing devices which face away from the tympanic membrane, the term "medial" refers to the direction and parts of hearing devices which face toward the tympanic membrane, the term "superior" refers to the direction and parts of hearing devices which face the top of the head, the term "inferior" refers to the direction and parts of hearing devices which face the feet, the term "anterior" refers to the direction and parts of hearing devices which face the front of the body, and the "posterior" refers to the direction and parts of hearing devices which face the rear of the body.

Figure 1:
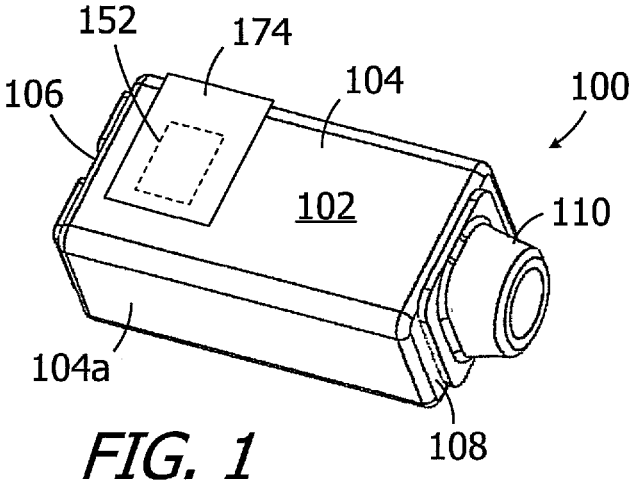
FIG. 1 is a perspective view of an exemplary receiver.
Figure 2:
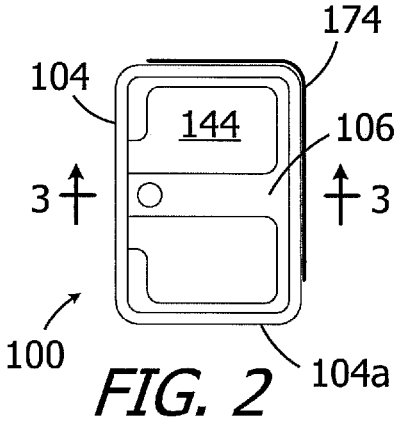
FIG. 2 is a rear view of the exemplary receiver illustrated in FIG. 1
Figure 3:
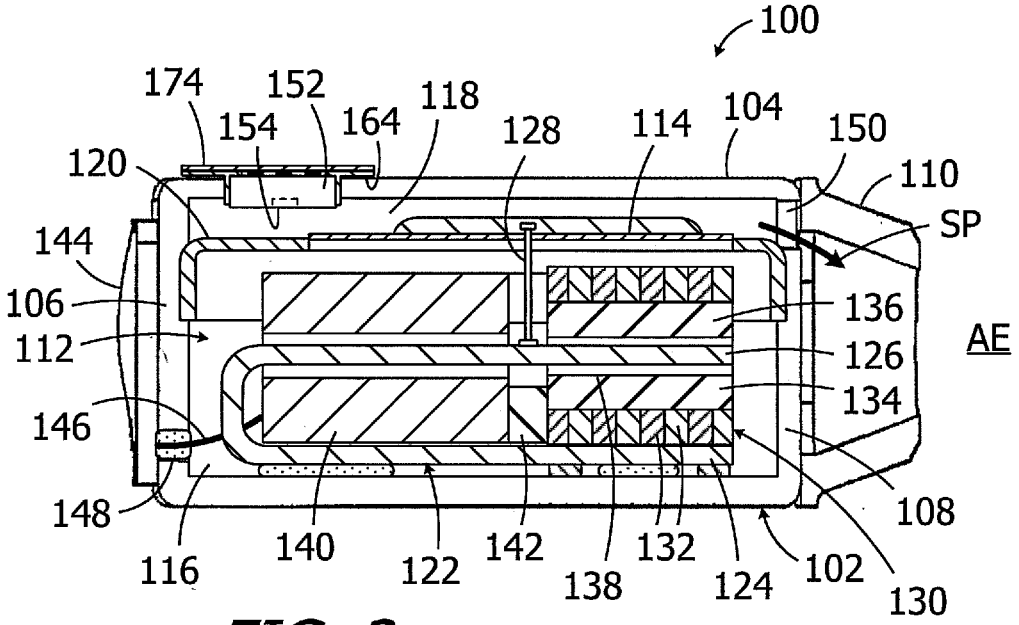
FIG. 3 is a partial section view taken along line 3-3 in FIG. 2.

One example of an acoustic transducer in accordance with the present inventions is the exemplary receiver 100, which converts electrical signals into sound waves, illustrated in FIGS. 1-3. The exemplary receiver 100 includes a housing 102 with elongate side walls 104 and 104*a*, end walls 106 and 108, and a sound port 110 that protrudes from one end of the housing. The housing 102 defines an internal volume 112 in which a diaphragm 114 is mounted. The diaphragm 114, which separates the internal volume 112 into a driver volume 116 and an output volume 118 that are isolated from one another, is held in place with a mounting bracket 120.

A U-shaped armature 122 is located within the driver volume 116. The armature 122 has a fixed portion 124 and a movable portion 126 that is connected to the diaphragm 114 by a drive rod 128. So connected, the diaphragm 114 moves in response to movement of the armature movable portion 126. A permanent magnet structure 130 also located within the driver volume 116. The permanent magnet structure 130 has a stack of ferromagnetic laminations 132 with central apertures that together form a space for a pair of permanent magnets 134 and 136. The laminations 132 are welded to the armature fixed portion 124, and the permanent magnets 134 and 136 define the central opening 138 of the permanent magnet structure 130. Part of the armature movable portion 126 is located within the central opening 138 and the permanent magnetic field within the central opening. Another part of the armature movable portion 126 is located within a drive coil 140 that is separated from the permanent magnet structure 130 by a C-shaped spacer 142. The orientation of the C-shaped spacer 142 is such that the drive rod 128 is located within the open space of the C-shape. Driving signals may be supplied to the drive coil 140 by way of electrical contacts 144, which are carried on the end wall 106, and a wire pair 146 that extends through a sealed opening 148.

Turning to the output volume 118, the output volume is exposed to the ambient environment AE by way of the sound port 110 and a sound aperture 150 in the end wall 108. During operation of the receiver 100, driving signals excite the drive coil 140. The excitation magnetizes the armature 122, which results in vibration of movable portion 126 and corresponding movement of the diaphragm 114. Movement of the diaphragm 114 produces sound in the output volume 118. The sound produced in the output volume 118 passes through the aperture 150 and sound port 110 along a sound path SP to the ambient environment AE.

Figure 4:
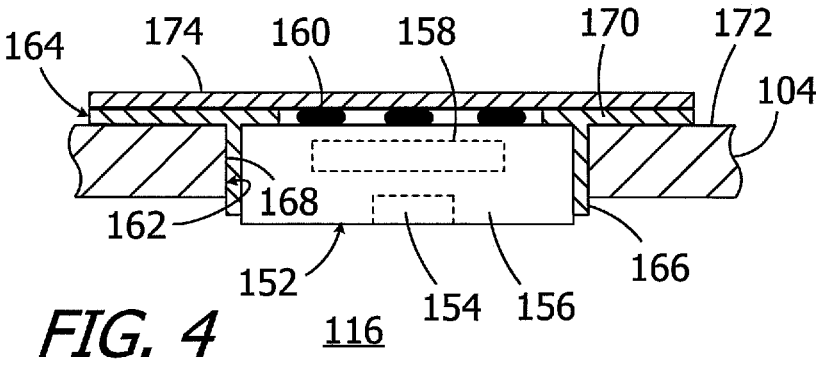
FIG. 4 is an enlarged view of a portion of FIG. 3.

The exemplary receiver 100 illustrated in FIGS. 1-3 also includes an environmental sensor 152, such as a humidity sensor, a temperature sensor or a combined humidity/temperature sensor, which has a sensor inlet 154 that is located within or otherwise directly exposed to the output volume 118. As such, the sensor inlet 154 is exposed to the ambient environment AE by way of the sound path SP defined by the outlet port 110 and sound aperture 150 in the housing 102 so that the sensor can sense the air in the ambient environment AE. Referring also to FIG. 4, the exemplary sensor includes a housing 156 with an internal volume, the aforementioned sensor inlet 154, sensor circuitry 158, and contacts 160.

Although the present inventions are not limited to any particular type of environmental sensor, the exemplary environmental sensor 152 is a capacitive sensor with a polymer dielectric that absorbs or releases water proportional to the relative environmental humidity, thereby changing the capacitance of the capacitor. The change in capacitance is measured by an electronic circuit that is part of the sensor circuitry. Suitable sensors are sold under the tradename CMOSens® by Sensirion AG in Staefa Switzerland. Other exemplary types of sensors include, but are not limited to, resistive and thermal sensors.

In the illustrated implementation, the environmental sensor 152 is mounted in the housing side wall 104 that faces the diaphragm 114 and, more specifically, is mounted in an aperture 162 that extends through the side wall. A seal 164, which may be positioned between the sensor 152 and side wall 104, includes a first portion 166 that is positioned between the aperture surface 168 and the sensor housing 156 and a second portion 170 that extends over the side wall top surface 172. A printed circuit board 174 may be used to connect the sensor contacts 160 to the printed circuit board of associated hearing assistance device, as is discussed below with reference to FIGS. 8-10. In the exemplary embodiment, the printed circuit board 174 extends around the housing 102 from the wall 104 through which the environmental sensor 152 extends to a narrower wall 104*a*. The contacts 176 of the printed circuit board, which are electrically connected to the sensor contacts 160, are located on the wall 104*a* (FIG. 9).

The exemplary environmental sensor 152 is located partially within receiver housing 102 in the lateral portion of the receiver 100. In other implementations, the environmental sensor may be located partially within receiver housing in the medial portion of the receiver. In still other implementations, the entire environmental sensor may be located within receiver housing. Here, the environmental sensor may be secured to the inner surface of the housing wall 104, and connected to apparatus outside the housing (e.g. the printed circuit board of a hearing assistance device) by a printed circuit board that passes between the end wall 106 and the mounting bracket 120 and through an opening in end wall on the driver volume 116 side.

Figure 5:
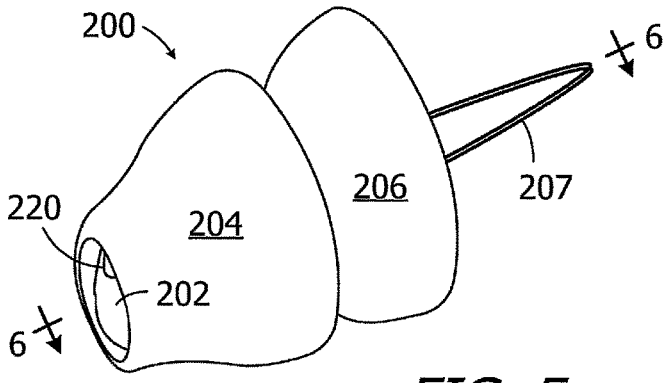
FIG. 5 is a perspective view of an exemplary hearing assistance device.
Figure 6:
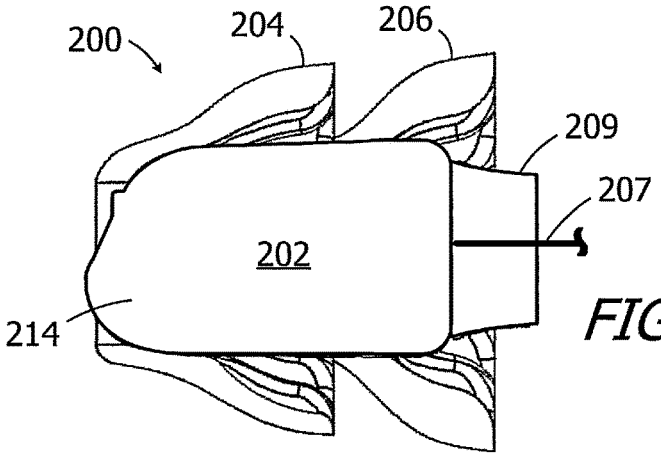
FIG. 6 is a partial section view taken along line 6-6 in FIG. 5.
Figure 7:
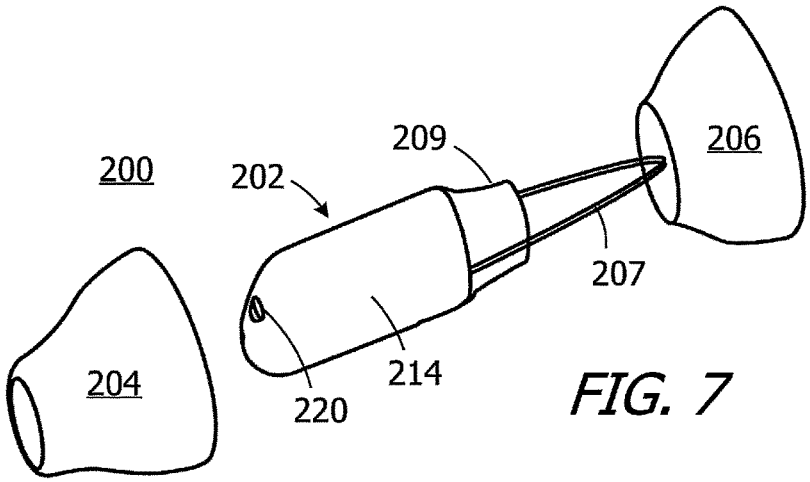
FIG. 7 is an exploded perspective view of the exemplary hearing assistance device illustrated in FIG. 5.
Figure 8:
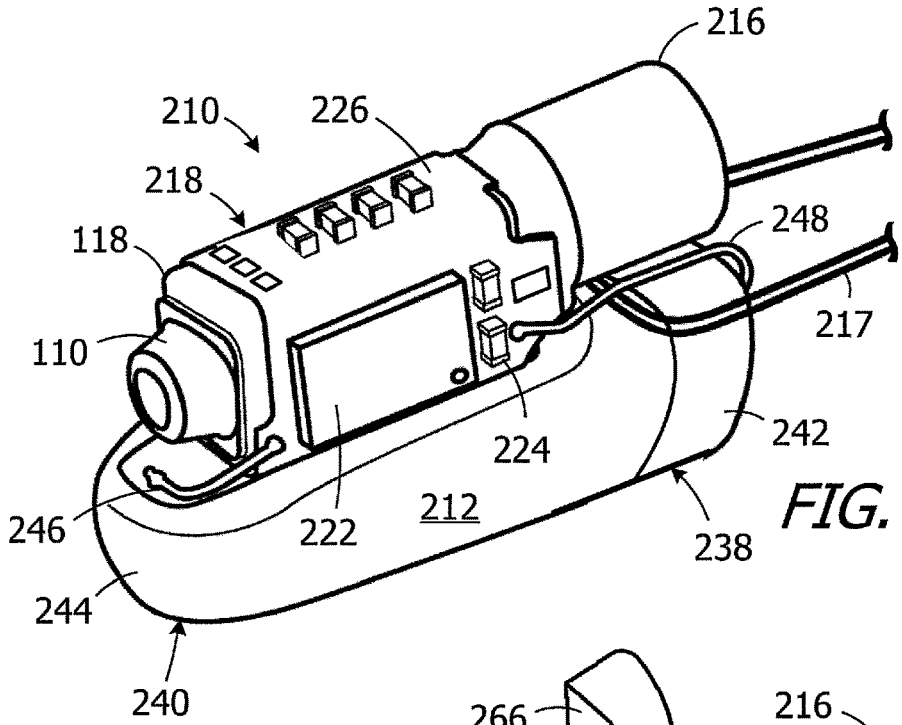
FIG. 8 is a perspective view of a portion of the exemplary hearing assistance device illustrated in FIG. 5.
Figure 9:
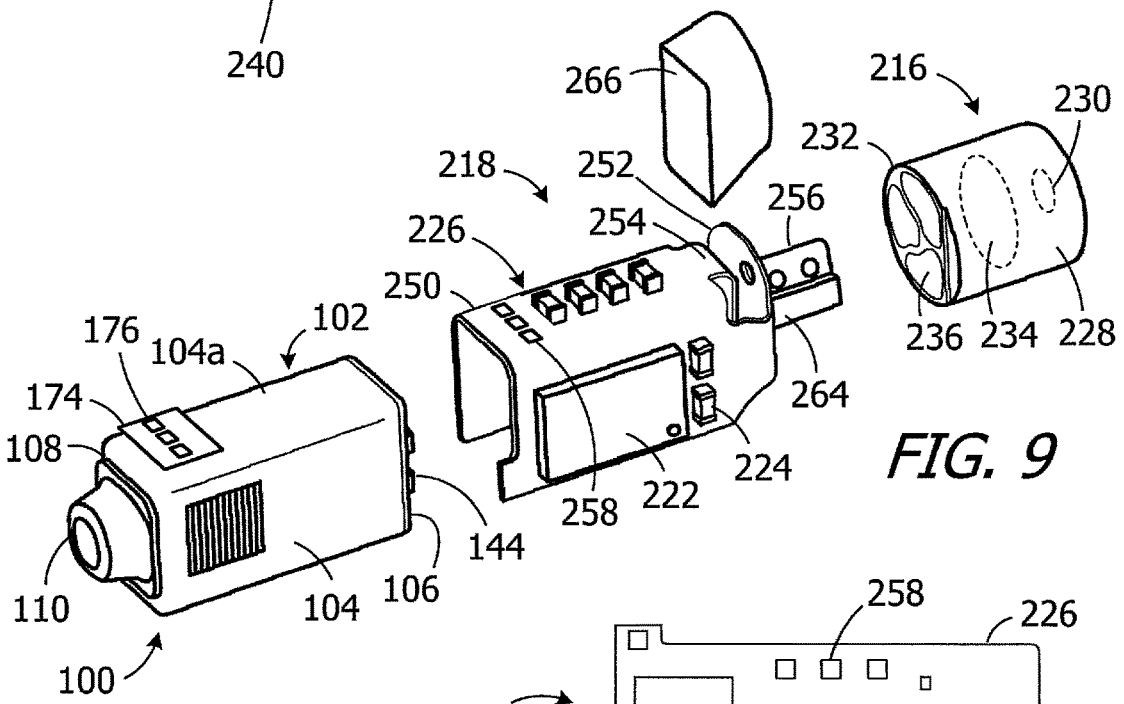
FIG. 9 is an exploded perspective view of a portion the exemplary hearing assistance device illustrated in FIG. 5.
Figure 10:
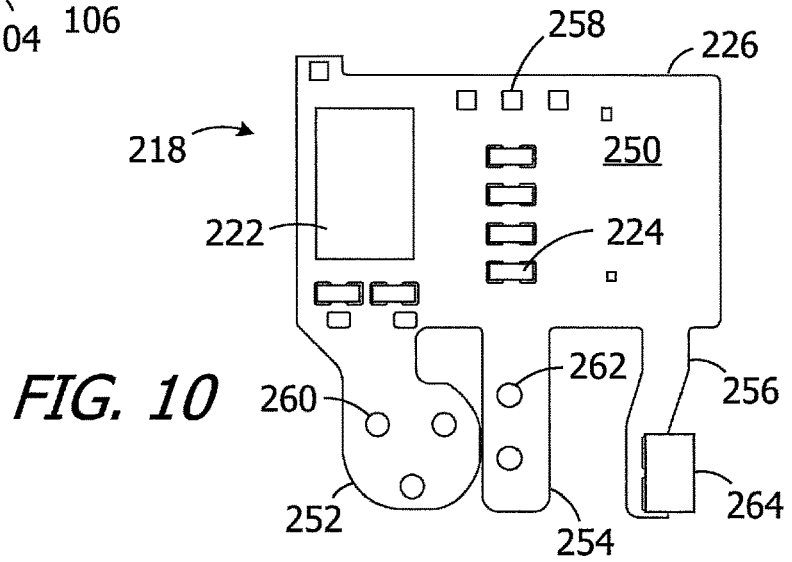
FIG. 10 is a plan view of a portion of the exemplary hearing assistance device illustrated in FIG. 5.

One example of a hearing assistance device that includes the exemplary receiver 100 is the hearing assistance device 200 illustrated in FIGS. 5-10. Referring first to FIGS. 5-7, the exemplary hearing assistance device 200 includes a core 202 as well as medial and lateral seals 204 and 206 that support the core within the ear canal bony portion. A handle 207 may also be provided. A contamination guard 209 with a screen (not shown) abuts the microphone 216 (FIG. 8). Turning to FIGS. 8-10, and although the present inventions are not limited to any particular core, the exemplary core 202 includes an acoustic assembly 210 and a battery 212 (e.g., metal-air battery) located within a housing 214 (FIG. 7). The acoustic assembly 210 has a microphone 216, the above-described receiver 100 and a flexible circuit 218. The receiver sound port 110 is associated with an aperture 220 on the housing 214. In some instances, a filter (not shown) may be provided within the sound port 110. The flexible circuit 218 has an integrated circuit or amplifier 222 and other discreet components 224 on a flexible substrate 226. The microphone 216 may have a housing 228, with a sound port 230 at one end and a closed end wall 232 at the other, a diaphragm 234 within the housing, and a plurality of electrical contacts 236 on the end wall 232 that may be connected to the flexible circuit 218 in the manner described below. It should be noted that in other implementations, the housing 214 may be omitted and the acoustic assembly 210, or the acoustic assembly 210 and the battery 212, or the acoustic assembly alone, may be encased by an encapsulant. Additional details concerning hearing assistance device cores may be found in U.S. Pat. No. 8,761,423, which is incorporated herein by reference.

The exemplary battery 212 has a cathode assembly 238 and an anode assembly 240. The exemplary cathode assembly 238 includes a battery can cathode portion 242 and an air cathode (not shown), and the exemplary anode assembly 240 includes a battery can anode portion 244 and anode material (not shown). The cathode assembly 238 and anode assembly 240 may initially be separate, individually formed structural elements that are joined to one another during the manufacturing process. The exemplary battery 212 is electrically connected to the flexible circuit 218 by way of anode and cathode wires 246 and 248. The battery may, in other implementations, be connected to a similar flexible circuit via tabs of the flexible circuit that attach to the battery, and in still other implementations, the anode and cathode wires may be omitted and replaced by anode and cathode contacts on the cathode assembly.

With respect to the exemplary flexible circuit 218 illustrated in FIGS. 8-10, the flexible substrate 226 includes a main portion 250 and a plurality of individually bendable tabs 252-256 that extend from the lateral end of the main portion. The flexible substrate main portion 250 may be configured to partially or completely cover one or more of the side walls 104/104*a* of the receiver housing 102 and, in the illustrated embodiment, the flexible substrate main portion covers substantially all (i.e., about 90%) of the surface area of both side walls 104 and one of the side walls 104*a*. The other side wall 104*a* abuts the battery 212. As a result, the main portion 250 is substantially U-shaped. The main portion 250 carries the integrated circuit 222 and the majority of the other discreet components 224 and may be secured to the receiver 100 with an adhesive. Suitable flexible substrate materials include, but are not limited to, polyimide and liquid crystal polymer (LCP). With respect to electrical connection, the main portion 250 also carries contacts 258 that may be soldered or otherwise connected to the contacts 176 (FIG. 9) that are associated with the environmental sensor 152. The tabs 252 and 254 carry the contacts 260 and 262 that may be soldered or otherwise connected to the contacts 144 and 236 on the receiver 100 and microphone. The exemplary contacts 258-262 extend completely through the flexible substrate 226. The tab 256 carries a switch 264 that is closed or opened (depending upon the type of switch) to control one or more aspects of the operation of the core 202 (e.g., volume setting). The switch 264 is located at the lateral end of the core 202 in the illustrated embodiment.

After the receiver 100 and microphone 216 have been connected to the flexible circuit 218 in the manner described above, the microphone, receiver and flexible circuit may be secured to one another with an adhesive 266 to complete the acoustic assembly 210. The adhesive 266 encapsulates the relatively small region between the receiver 100 and microphone 216 in which the flexible circuit tabs 252 and 254 are located and directly bonds the microphone to the receiver. So attached, the acoustic assembly 210 is a unitary structure that may be mounted onto the battery 212 and secured thereto with, for example, adhesive.

The seals 204 and 206 support the core 202 within the ear canal bony portion and are configured to substantially conform to the shape of walls of the ear canal, maintain an acoustical seal between a seal surface and the ear canal, and retain the hearing device 200 securely within the ear canal. The medial and lateral seals 204 and 206 are substantially similar, but for minor variations in shape, and the seals are described with reference to medial seal 104 in the interest of brevity. Additional information concerning the specifics of exemplary seal apparatus may be found in U.S. Pat. No. 7,580,537, which is incorporated herein by reference. Suitable materials include elastomeric foams having compliance properties (and dimensions) configured to conform to the shape of the intended portion of the ear canal (e.g., the bony portion) and exert a spring force on the ear canal so as to hold the hearing assistance device 200 in place in the ear canal. Exemplary foams, both open cell and closed cell, include but are not limited to foams formed from polyurethanes, silicones, polyethylenes, fluoropolymers and copolymers thereof.

Figure 11:
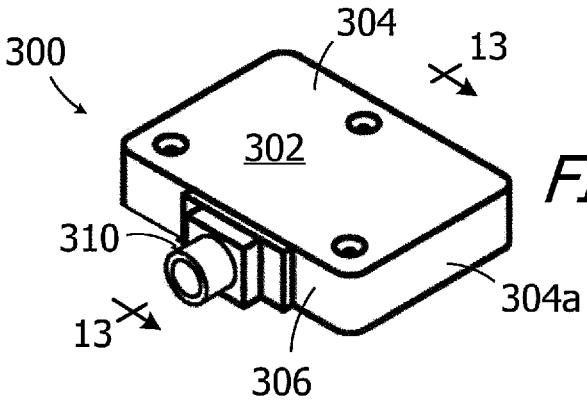
FIG. 11 is a front perspective view of an exemplary microphone.
Figure 12:
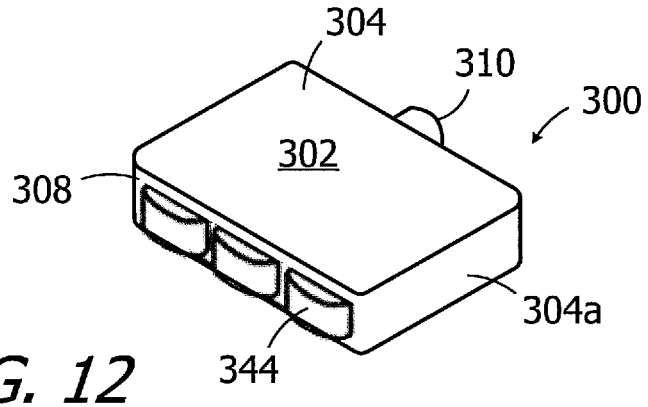
FIG. 12 is a rear perspective view of the exemplary microphone illustrated in FIG. 11.
Figure 13:
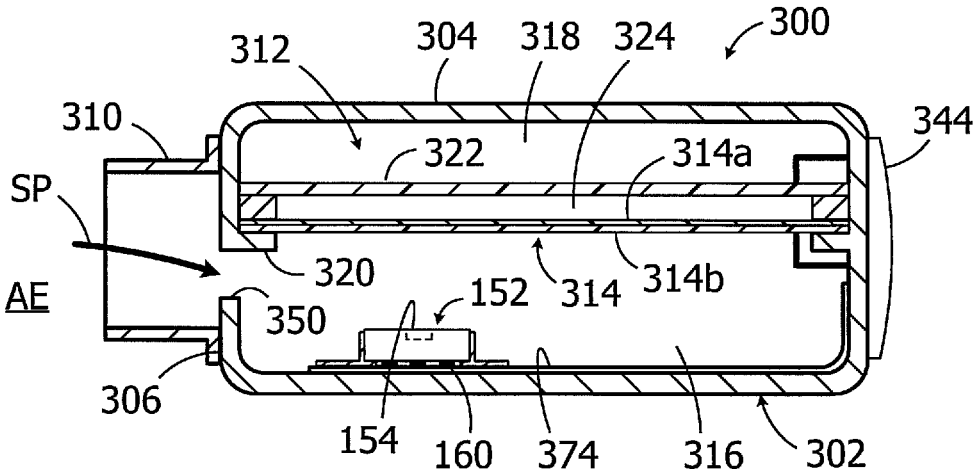
FIG. 13 is a partial section view taken along line 13-13 in FIG. 11.

Another example of an acoustic transducer in accordance with the present inventions is the exemplary electret microphone 300 illustrated in FIGS. 11-13, which may be incorporated into a hearing assistance device such as, for example, the hearing device 200. The exemplary microphone 300, which converts sound waves into electrical signals, includes a housing 302 with elongate side walls 304 and 304*a*, end walls 306 and 308, and a sound port 310 that protrudes from one end of the housing. The housing 302 defines an internal volume 312 in which an electret diaphragm 314 is mounted. The diaphragm 314, which separates the internal volume 312 into an input volume 316 and a back volume 318 that are isolated from one another, includes a polymer film 314*a* and a metal layer 314*b* and is held in place with a mounting bracket 220. The metal layer 314*b* is connected to one of the contacts 344 on the housing end wall 308. A back electrode 322, which is connected to another one of the contacts 344, is separated from the diaphragm 314 by an air gap 324. A charge on the film 314*a* creates an electric field across the air gap 324.

The input volume 316 is exposed to the ambient environment AE by way of the sound port 310 and a sound aperture 350 in the end wall 306. During operation of the microphone 300, sound waves enter the input volume 316 by way of the sound path SP defined by the sound port 310 and aperture 350. The sound waves impinging on the diaphragm 314 modulate the electric field and generate a voltage drop across the metal layer 314*b* and the back electrode 322.

Referring more specifically to FIG. 13, the exemplary microphone 300 also includes an environmental sensor 152, such as a humidity sensor, a temperature sensor or a combined humidity/temperature sensor, which is discussed in greater detail above with reference to FIG. 4. The entire environmental sensor 152 is located within the input volume 316. The sensor inlet 154 is exposed to the ambient environment AE by way of the sound path SP defined by the sound port 310 and sound aperture 350 in the housing so that the sensor can sense the air in the ambient environment AE. The sensor contacts 160 are connected to a printed circuit board 374, and may be connected to the flexible circuit 218 by way of the printed circuit board 374, contacts (not shown) on flexible circuit tab 256 (FIG. 9), and feedthrough pins (not shown) that extend through the housing 302 from the contacts to the printed circuit board.

Although the inventions disclosed herein have been described in terms of the preferred embodiments above, numerous modifications and/or additions to the above-described preferred embodiments would be readily apparent to one skilled in the art. By way of example, but not limitation, the inventions include any combination of the elements from the various species and embodiments disclosed in the specification that are not already described. It is intended that the scope of the present inventions extend to all such modifications and/or additions and that the scope of the present inventions is limited solely by the claims set forth below.

We claim:

1. An electro-acoustic transducer, comprising:

a housing having a plurality of walls that define an interior volume, with a first interior volume portion, a sealed second interior volume portion, and a sound aperture that extends through at least one of the walls to the first interior volume portion;

a diaphragm that separates the first interior volume portion from the sealed second interior volume portion and that seals the sealed second interior volume portion;

an electrical component within the sealed second interior volume portion and operably associated with the diaphragm; and an environmental sensor associated with the housing and having an inlet in fluid communication with the first interior volume portion.

2. The electro-acoustic transducer of claim 1, wherein the housing includes a sensor aperture that extends into the first interior volume portion; and at least a portion of the environmental sensor is located within the sensor aperture.

3. The electro-acoustic transducer of claim 1, wherein the environmental sensor inlet is located within the first interior volume portion.

4. The electro-acoustic transducer of claim 1, wherein the entire environmental sensor is located within the first interior volume portion.

5. The electro-acoustic transducer as claimed in claim 1, wherein the electrical component comprises an armature that is connected to the diaphragm.

6. The electro-acoustic transducer as claimed in claim 1, wherein the diaphragm comprises an electret microphone diaphragm; and the electrical component comprises an electrode that is adjacent to the electret microphone diaphragm.

7. The electro-acoustic transducer as claimed in claim 1, wherein the environmental sensor is selected from the group consisting of capacitive sensors, resistive sensors and thermal sensors.

8. The electro-acoustic transducer as claimed in claim 1, wherein the environmental sensor senses humidity and/or temperature.

9. A method for use with a hearing device acoustic transducer having a housing, with a sound aperture and an interior volume that is separated by a diaphragm into a first interior volume portion that is in fluid communication with the sound aperture and a sealed second interior volume portion, and an electrical component within the sealed second interior volume portion and operably associated with the diaphragm, the method comprising the step of:

sensing environmental data from within the first interior volume portion of the hearing device acoustic transducer.

10. The method of claim 9, wherein the environmental data comprises humidity and/or temperature.

11. The method as claimed in claim 9, wherein the acoustic transducer comprises a receiver, the first interior volume portion comprises an output volume, and the environmental data is sensed by way of a sensor inlet that is located within or otherwise directly exposed to the output volume.

12. The method as claimed in claim 9, wherein the acoustic transducer comprises a microphone, the sealed second interior volume portion comprises an input volume, and the environmental data is sensed by way of a sensor inlet that is located within or otherwise directly exposed to the input volume.

13. A hearing device, comprising:

a microphone including a microphone housing having a plurality of walls that define a microphone interior volume, with a first microphone interior volume portion and a sealed second microphone interior volume portion, and a microphone sound aperture that extends through at least one of the walls to the first microphone interior volume portion, an electret microphone diaphragm that separates the first microphone interior volume portion from the sealed second microphone interior volume portion and that seals the sealed second microphone interior volume portion, and an electrode within the sealed second microphone interior volume portion that is adjacent to the electret microphone diaphragm;

a receiver including a receiver housing having a plurality of walls that define a receiver interior volume, with a first receiver interior volume portion and a sealed second receiver interior volume portion, and a receiver sound aperture that extends through at least one of the walls to the first receiver interior volume portion, a receiver diaphragm that separates the first receiver interior volume portion from the sealed second receiver interior volume portion and that seals the sealed second receiver interior volume portion, and an armature that is within sealed second receiver interior volume portion and that is connected to the diaphragm; and an environmental sensor associated with one of the microphone housing and the receiver housing and having a sensor inlet in fluid communication with the first interior volume portion of the associated microphone housing or receiver housing.

14. The hearing device of claim 13, wherein the associated microphone housing or receiver housing includes a sensor aperture that extends into the first interior volume portion; and at least a portion of the environmental sensor is located within the sensor aperture.

15. The hearing device of claim 13, wherein the environmental sensor inlet is located within the first interior volume portion of the associated microphone housing or receiver housing.

16. The hearing device of claim 13, wherein the entire environmental sensor is located within the first interior volume portion of the associated microphone housing or receiver housing.

17. The hearing device of claim 13, further comprising:

a battery; and circuitry connected to the battery, receiver and microphone.

18. The hearing device of claim 17, wherein the microphone, receiver, environmental sensor, battery and circuitry are located with a hearing device housing having an exterior;

at least one seal is carried on the exterior of the hearing device housing; and the hearing device is sized and shaped to fit within an ear canal.

19. The hearing device as claimed in claim 13, wherein the environmental sensor is selected from the group consisting of capacitive sensors, resistive sensors and thermal sensors.

20. The hearing device as claimed in claim 13, wherein the environmental sensor senses humidity and/or temperature.

* * * * *